United States Patent [19]

Tillotson, III et al.

[11] Patent Number: 4,978,442

[45] Date of Patent: Dec. 18, 1990

[54] MAGNETIC SEPARATOR HAVING HIGH RATE OF FIELD CHANGE CAPABILITY

[75] Inventors: James A. Tillotson, III, Los Altos; Kenneth M. Crowe, Richmond, both of Calif.

[73] Assignee: Pacific Electric Motor Co., Oakland, Calif.

[21] Appl. No.: 399,381

[22] Filed: Aug. 24, 1989

Related U.S. Application Data

[63] Continuation of Ser. No. 166,295, Mar. 8, 1988, abandoned.

[51] Int. Cl.[5] ..... B03C 1/02; B03C 1/14

[52] U.S. Cl. ..... 209/215; 209/223.1; 209/232; 363/87; 363/129

[58] Field of Search ..... 209/213–215, 209/223.1, 232; 363/128, 129, 87, 85

[56] References Cited

U.S. PATENT DOCUMENTS 4,282,569 8/1981 Hardwick et al. ..... 363/87

4,447,868 5/1984 Turnbull ..... 363/87

*Primary Examiner*—Joseph J. Rolla
*Assistant Examiner*—Steven Reiss
*Attorney, Agent, or Firm*—Townsend and Townsend

[57] ABSTRACT

A large magnetic separator for separating magnetic fines from nonmagnetic product is equipped with a dual mode power supply. A first mode of the dual power supply is provided for accelerated imposition of the design magnetic field. A second mode of the dual power supply is provided for the maintenance of the desired magnetic field at an improved power factor, which field is in the range of 20 kilogauss. With the field imposed, a canister centrally placed in the magnet with a magnetic stainless steel wool matrix separates magnetic fines from nonmagnetic product until the matrix is saturated. Upon saturation of the matrix, the power supply dissipates to the power grid electrical energy from the collapse of the magnetic field. There results a larger classifying duty cycle of the high stationary magnetic fluid utilized for classification.

4 Claims, 4 Drawing Sheets

TYPICAL

MAGNETIC SEPARATOR HAVING HIGH RATE OF FIELD CHANGE CAPABILITY

This is a continuation of application Ser. No. 166,295, filed Mar. 8, 1988, now abandoned.

BACKGROUND OF THE INVENTION

This invention relates to magnetic separators. More particularly, dual mode power supplies are utilized to drive a large magnet to and from its operating and constant magnetic field with the result that separator duty cycle in classifying magnetic particles from nonmagnetic product is improved.

SUMMARY OF THE PRIOR ART

Large magnets for the classification of magnetic impurities from nonmagnetic products are known. An example of such a magnet would be a magnet processing clay and removing magnetic impurities naturally mined with the clay.

Typically, such magnets have a large central canister. The canister contains a magnetically conductive filament structure such as stainless steel wool.

The canister is placed in the center of a large magnet structure. The magnet structure includes a soft steel magnetic field conducting core which core has in the prior art been made from large beams. These large beams are required to have their height equal to or greater than the width. The length of the large beams must be at least four times the width. The large beams enable convenient assembly and disassembly of the magnet and additionally serve to render the magnetic field across the canister more uniform.

The magnetic field is introduced to the large core by water cooled copper coils. These water cooled copper coils typically surround the canister and are internal to the magnetic field conducting core. When the large water cooled coil is supplied with DC current, a very large magnetic field slowly builds.

The resultant fields used for classification of magnetic impurities from nonmagnetic product is large. Fields in the order of 20 kilogauss are not uncommon. Due to the very large inductance, as much as 3 to 5 minutes therefore can be required for the necessary 20 kilogauss field to establish itself. Likewise, when the field decays, again 3 to 5 minutes can be required for field decay.

Cycle of such a magnet in processing magnetic impurities is easy to understand. The magnet is typically brought on line for that period of time necessary to bring on the magnetic field. Once the magnetic field is present, the slurry containing the magnetic and nonmagnetic particles is run through the canister. The magnetic field conducting matrix within the canister in the high magnetic field (20 kilogauss) collects the nonmagnetic particles. Thereafter and when the magnetic stainless steel matrix in the canister is saturated, flow of the product is stopped. Typically, the magnetic field is reduced to zero.

When the field reaches zero, the matrix is backwashed. Typically, the matrix is backwashed to a pool where the magnetic particles can be safely accumulated and disposed of.

It is, of course, known that magnets that are designed for rapidly changing fields can be laminated. For example, the transformers providing 60 hertz of power have a laminations in the order of less than 1/16th of an inch thick. Unfortunately for the large stationary size of the field herein required, such laminations are not appropriate. The extreme physical size of the thin laminations used in these large magnets present formidable difficulties in manufacturing. For example, improperly fabricated lamination can be crushed by the magnetic field. Conversely properly constructed laminations are expensive.

It is heretofore been known to feed power from a regenerative load back into the power grid.

DISCOVERY

I have discovered that large magnets having large beam construction set forth in the description of the prior art experience a reduction in counter electromagnetic forces (EMF), during periods of rapid changes in the magnetic field. These lower electromagnetic forces are a direct result of shorter eddy current paths lengths. It is important to distinguish that the total steady state magnetic field produced in these magnets is not linked to the eddy current problem.

Consequently and because of this discovery, we propose an accelerated protocol for imposing the classifying magnetic field onto the magnet. This accelerated protocol includes a dual mode power supply. One mode of the power supply is for imposing an accelerated basis, a magnetic field. The remaining power supply mode is for maintaining the imposed steady state magnetic field. Either power supply can be used to accelerate the removal of the imposed magnetic field.

SUMMARY OF THE INVENTION

A large magnetic separator for separating magnetic fines from nonmagnetic product is equipped with a dual mode power supply. A first mode of the dual power supply is provided for accelerated imposition of the design magnetic field. A second mode of the dual power supply is provided for the maintenance of the desired magnetic field at an improved power factor, which field is in the range of 20 kilogauss. With the field imposed, a canister centrally placed in the magnet with a magnetic stainless steel wool matrix separates magnetic fines from nonmagnetic product until the matrix is saturated. Upon saturation of the matrix, the power supply dissipates to the power grid electrical energy from the collapse of the magnetic field. There results a larger classifying duty cycle of the high stationary magnetic field utilized for classification.

OTHER OBJECTS, FEATURES AND ADVANTAGES

An object of this invention is to disclose a dual mode power supply rectifying network for accelerating a magnet and maintaining at its classifying field. Accordingly, the first and second modes require two independent sets of rectifiers. The first set of rectifiers have a high voltage output and are used for acceleration the imposition of a magnetic field on the magnet. The second set of silicon controlled rectifiers have a lower voltage output and are utilized to correct the power factor and maintain the magnetic field once the field has been imposed.

An advantage of the disclosed power supply in combination with the beam constructed magnet is that the magnet comes to its full field for classification of clay containing slurries on a faster basis. Simply stated, the transient of the imposition of the magnetic field is covered with maximum possible speed.

A further advantage of the dual mode power supply package is that power factor for on line operation of the magnet is increased. Specifically, and by utilizing a second set of silicon control rectifiers, power is delivered to the magnet with a maximum power factor. Power factors in excess of 0.8 and approaching unity have been realized.

Yet another object of this invention is to disclose use of the either group of rectifiers for decay of the field and feeding the power of magnetic collapse back to the grid. Accordingly, a protocol for driving the silicon controlled rectifiers in line commutated conversion is disclosed.

An advantage of this aspect of the invention is that again the laminated construction of the magnet has been discovered to facilitate faster rates of rise and decay of the magnetic field than heretofore thought possible.

An advantage of the dual mode power supply is that the overall duty cycle of the magnet being on line and capable of classifying magnetic impurities from non-magnetic product is increased.

The term duty cycle is used in this disclosure. Duty cycle is defined as the time spent classifying out magnetic particles from product divided by the total time spent both classifying out magnetic particles from product, the time spent cleaning, as well as the time spent imposing and decaying the magnetic field. It will therefore be understood that this disclosure in reducing the time spent imposing and decaying the magnetic field materially improves the duty cycle.

BRIEF DESCRIPTION OF THE DRAWINGS

Other objects, features and advantages will become more apparent after referring to the following specification and attached drawings in which:

Referring to FIG. 1, a prior art magnet M is illustrated. Magnet M is of a beam construction having 18 side-by-side top beams 14 and 18 side-by-side bottom beams 16. Between the respective layers of top beams 14 and bottom beams 16, there is a beam core construction 18. Beam construction 18 forms a cylindrical concavity within the magnet. This cylindrical concavity is for containing coils 20 and a classifying canister 22.

Figure 1:
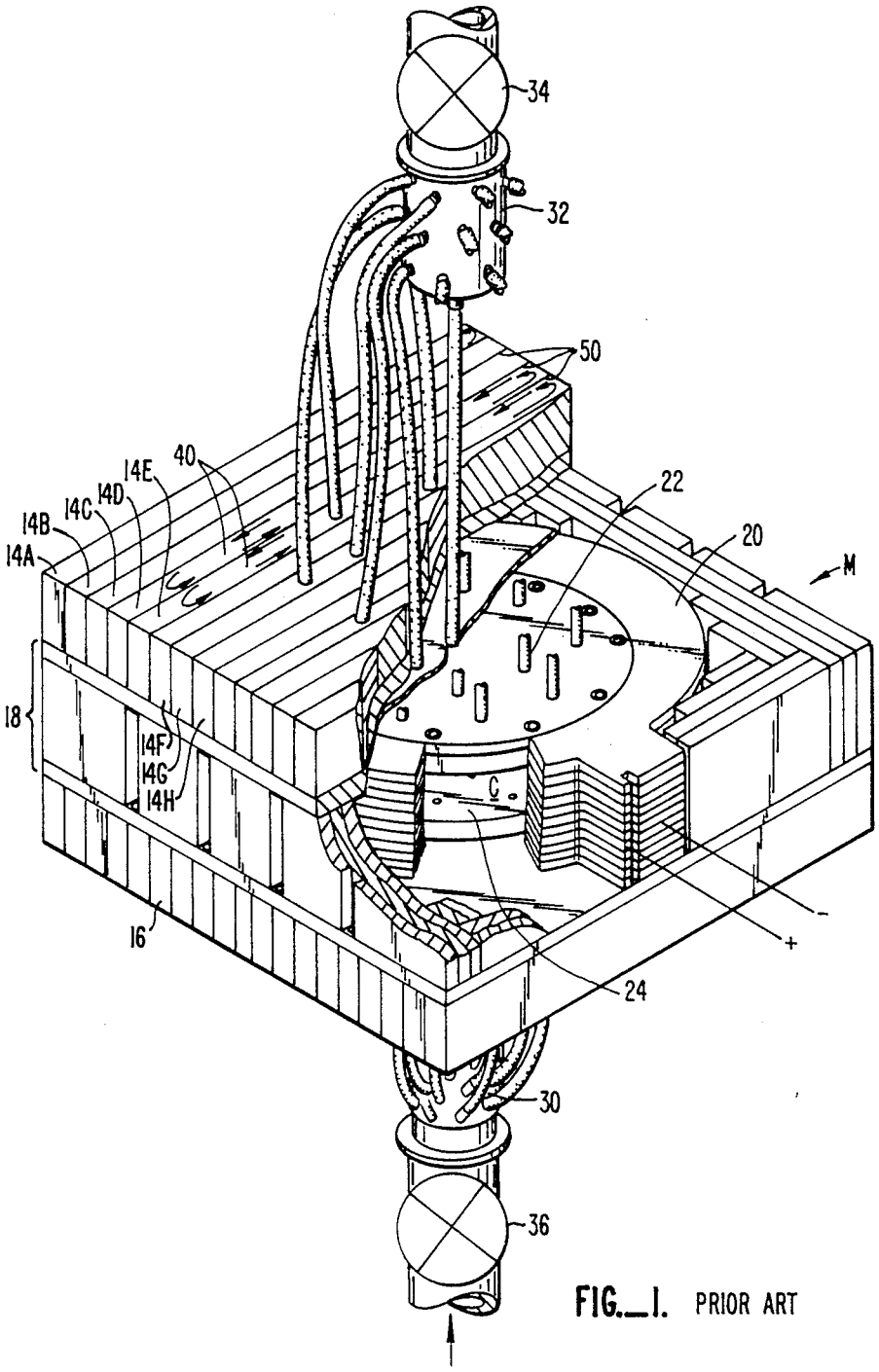
FIG. 1. PRIOR ART
FIG. 1 is a perspective view of a prior art magnet having beam construction, the magnet containing a steel wool filled canister in the order of 120-inches and being fabricated from a laminated beam construction.

Beams 14 are large. A typical dimension includes lengths of 6 to 22-feet a width of 6 to 12-inch and a depth of 12-36-inches. The beams are constructed of soft, magnetic field conducting steel, such as ASTM (American Society of Testing and Material Standard #) 1010 Steel.

Canister 22 is filled with a stainless steel matrix 24. This matrix 24 is the site to which magnetic particles cling once classification occurs.

When the magnetic field is on line and operating, a bottom manifold 30 and a top manifold 32 cause a slurry of clay to be pumped through the magnet canister 22. The slurry of clay is distributed to a number of individual pipes, which individual pipes pass through the canister C at individual conduits. These pipes are collected by a manifold assembly 32.

The stainless steel matrix 24 interior of the magnet catches the magnetic particles. When the stainless steel matrix 24 becomes saturated and can no longer hold particles, two things happen.

First, the magnetic field is collapsed.

When the magnetic field is collapsed, diverter valves 34, 36 are switched. Fluid is backflushed from manifold 32 to manifold 30 and out to a collection area for the flushed magnetic particles. Because the magnetic field is collapsed, the classified magnetic particles are released from the matrix 24.

It will be understood that the divert valve shown here are a simplification of those utilized in a real installation. The valves here shown are for the purpose of illustrating the operating principles of the disclosure only.

It will be appreciated that magnet M is largely under a static field. That is to say when it is on line and classifying magnetic impurities from nonmagnetic product, a field in the order of 20 kilogauss exists across the magnet. This very large and static magnetic field has several consequences.

First, it requires that beams 14, 16, and beam construction 18 be large and sturdy, beam construction. The forces pulling the beams together are very large. Conventional laminated constructions used in other magnets (for example transformers with rapidly fluctuating fields) would be wholly unsatisfactory.

Secondly because of the scale factors involved, the imposition of the magnetic field and its ultimate decay induces eddy currents. These currents resist the collapse of the magnetic field.

Figure 2:
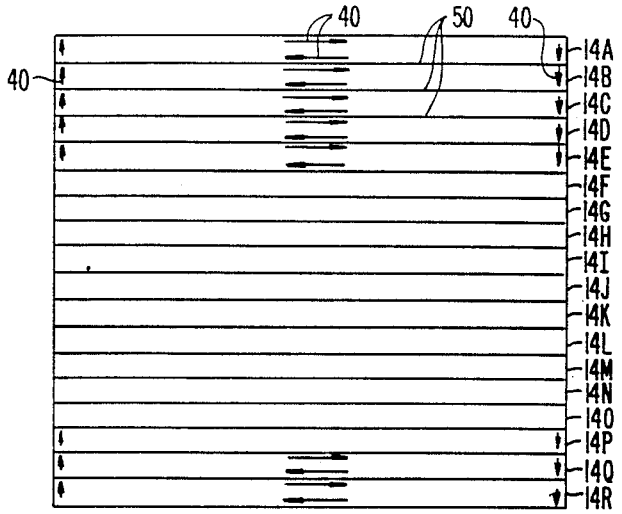
FIG. 2 is a schematic sketch illustrating a layer of beams in the magnet of FIG. 1 and illustrating how the beams react to impose eddy currents during change of magnetic field in accordance with the discovery of this invention.

Referring to FIG. 2, the phenomenon utilized by the dual mode power supply herein disclosed is set forth. Specifically, FIG. 2 illustrates either a top view or a bottom view of the magnet of FIG. 1. Each of the 18 beams (14A through 14R) is shown. It is the subdivision of these beams which have been discovered to reduce the eddy current enables the rapid build up and decay of the magnetic field as set forth in this invention.

First, it is important to understand the theory behind eddy currents induced by change of magnetic field. Specifically, the eddy currents shown in FIG. 2 only arise when the magnetic field is changed. Change occurs in two discrete portions of the cycle of the magnet discussed with respect to FIGS. 1 and 2. When the field is initially imposed, eddy current flow occurs. Specifically, each beam, such as beam 14A, will include eddy current paths 40. Paths 40 define a circular eddy current loop through each of the beams 14A through 14R.

The eddy current arise from an induced voltage which is directly proportional to the area available for current flow. The area for current flow is reduced because of the laminate beam construction herein illustrated.

To prevent eddy current transients from jumping between the beams 14A thru 14R, it is desirable to put layers of insulation 50 respectively between the beam side edges. Such layers of insulation prevent current flows from jumping across the side-by-side beams and thus enable rapid rates of change of the magnetic field.

It should be understood that because of the very large scale involved, the problem herein set forth is rarely—if ever—encountered. In these magnetic separators, specifically, because a classifying canister is 60-inches and larger in diameter and because the magnet itself is six to ten feet high and six to twenty feet square, eddy current flows resisting changes of magnetic field of this scale are rarely encountered. It is the discovery that the laminated beam construction reduces the eddy current flow that is important to the enablement of the dual mode power supply with the effectiveness set forth herein.

The reader will thus understand that duty cycle is sought to be maximized. That is to say, that interval period of time while the magnet is on line and at full magnetic field and classifying magnetic impurities from nonmagnetic product is sought to be maximized.

This leaves three discrete phases of the cycle of the magnet which must be minimized.

First, is the backwash time. It will be appreciated that the time interval required for backwashing the stainless steel matrix cannot be appreciably altered.

Second, is the time in which the large magnetic field necessary for classification is imposed upon the magnet.

Finally, there is that time period in which the magnetic field required for classification decays.

These latter two intervals are altered by the power supply configuration of this invention.

Figure 3A:
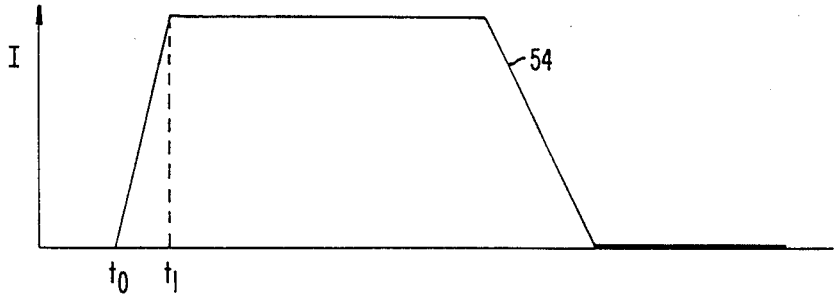
FIGS. 3A and 3B are respective current in magnetic field diagrams with respect to time illustrating areas of inefficiency and illustrating how the imposition of a more rapid magnetic field effects an improved duty cycle.
Figure 3B:
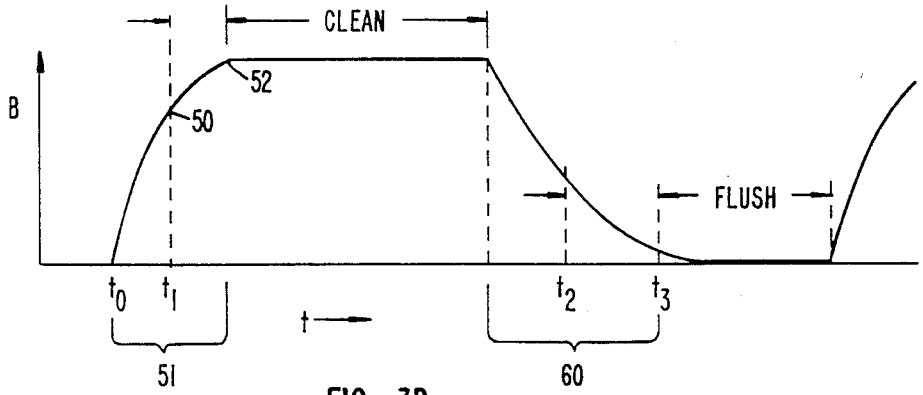

Referring to FIGS. 3A and 3B, the effect of improving the duty cycle can be illustrated.

Referring to FIG. 3B, the magnetic field B of the magnet is plotted against time for one full cycle of the magnet. Typically the time period for a full cycle involved is in the order of 15 minutes.

Referring to FIG. 3A, at time $t_0$, a magnetic field is imposed on the magnet of FIG. 1. This is done by a direct current I.

Current I comes from the first mode $t_0$ power supply and is left on for a relatively short interval of time (in the order of 3 minutes). Current sufficient to produce a 20 kilogauss field is imposed through the water cooled coils 20 surrounding the canister C. At time $t_1$, the first mode power supply is switched off. The second mode of power supply imposes the normal sustaining current upon the magnet M with a high power factor.

Referring to FIG. 3B, will be seen that at point 50 the full magnetic field has not been realized. An operation of the magnet under the maintenance current for approximately a one minute period until point 52 is required before slurry flow and cleaning can result through the magnet.

Cleaning or classification out of the magnetic particles occurs for a period of time in the order of 15 minutes. At the end of 15 minutes, the stainless steel matrix 24 within the canister C becomes saturated. Further retention of magnetic particles is inhibited. Cleaning of the slurry is reduced. Accordingly, back flushing is required.

At the time of back flushing, the magnetic field must be removed. Removal of the field is required before magnetic particles can be released from the stainless steel matrix 24. Accordingly, a collapse of the field is required.

As will hereinafter be set forth, either mode of the power supply may be utilized to brake the magnetic field. By utilizing line commutated conversion as hereinafter described, a current flow 54 decelerates the magnetic field.

It will be appreciated that this line commutated conversion recovers the energy of the magnetic field. As is known in the prior art, this field happens to be communicated back to the power grid.

It is more important to note, however, that the eddy current effect discussed herein is not related to this energy recovery. The eddy current effect is instead a measure of how fast the field can be cycled and the duty cycle improved. Again it will be understood that the laminate beam construction of the magnet and the reduced magnitude of the eddy currents contributes to this rapid field decay.

As can be seen from FIG. 3B, the decay period 60 is required before flushing can occur.

In sum, two periods are sought to be minimized by this invention. The first period is that interval of time 51 in which it takes the magnet to come to full classifying magnetic field.

The second period of time is that time interval 60 in which the magnetic field is reduced. It has been discovered that the laminated beam 20 construction illustrated in FIG. 2 is particularly suitable to and necessary for the dual mode power supply drive herein disclosed.

Figure 4:
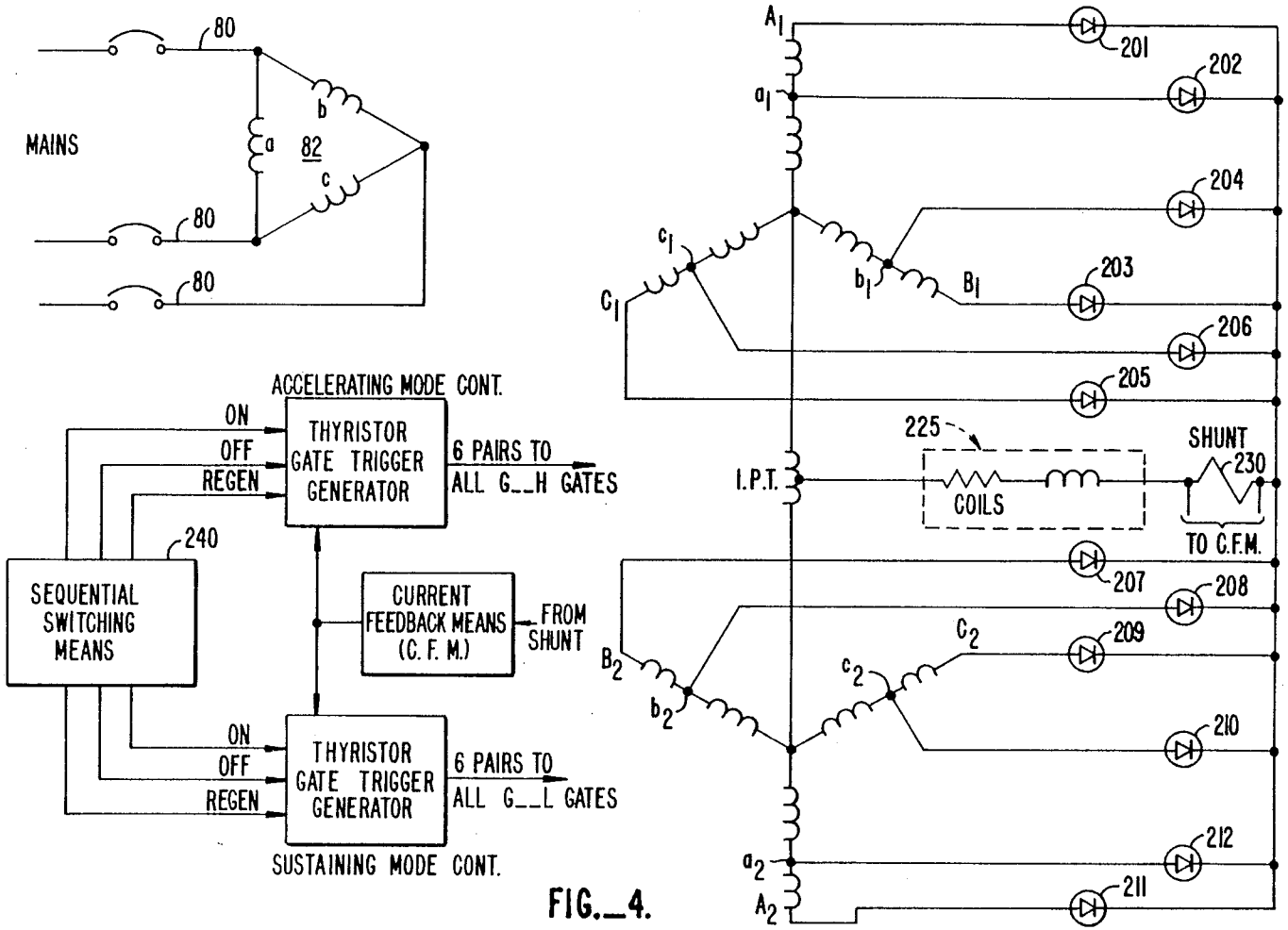
FIG. 4 is a typical schematic diagram of a transformer having a six phase star connection with interphase transformer connected thereto and includes an attached schematic of the dual mode power supply utilized for driving the magnet rapidly to its operating field.

Referring to FIG. 4, a typical rectifier system for accelerating the initial imposition of the magnetic field is disclosed. This system uses rectifiers 201, 203, 205, 207, 209, and 211. A second rectifier system is disclosed for maintaining the field and correcting the power factor once it is initially imposed. This system uses rectifiers 202, 204, 206, 208, 210, and 212.

Silicon controlled rectifiers (thyristors) 201-212 are used. These rectifiers are of the large "hockey puck" construction.

Power from each of the phases A, B, and C are utilized. This dual mode power supply is connected as a dual conventional six phase star with IPT power supply.

The silicon controlled rectifiers utilized with each of the power supplies operate at different voltages. Specifically the silicon control rectifiers 201, 203, 205, 207, 209, and 211 are driven off of a higher ACV to supply a higher D.C. voltage well beyond the designed maintenance DCV needed to maintain the classifying field in magnet M.

It will be appreciated that these silicon controlled rectifiers will never reach their full rated output current. Instead, these rectifiers will be used to accelerate the field between time $t_0$ and time $t_1$. At that time, rectifiers 201, 203, 205, 207, 209 and 211 will be phased out. Rectifiers 202, 204, 206, 208, 210, and 212 will take over and maintain the load.

Silicon controlled rectifiers of the type herein illustrated only are capable of being turned on when a positive voltage is across the solid state device. Accordingly, control lines are schematically illustrated going to each individual silicon controlled rectifier. The control circuitry is schematically illustrated with respect to FIG. 4.

It will be understood that the single line schematic illustrated at each rectifier in reality includes many such lines.

It can be seen from the circuit schematic that a six phase double "Y," line commutated converter with interphase transformer is illustrated. Silicon rectifiers are all arrayed for the conversion of DC current from the three phase AC power supply. This circuit is, for the most part, conventional.

The circuit does include a connection 225 for the coils of the magnet and a shunt 230. Shunt 230 is the current monitoring point for the controls of this circuit.

There is illustrated herein a sequential switching means 240 for switching between the respective power supplies. This is manual and comprises timing and observing the current in the magnet as it accumulates and throwing switches as appropriate to shift the load between the sets of silicon rectifiers 201, 203, 205, 207, 209, 211 and 202, 204, 206, 208, 210, 212. I am currently in the process of developing automated switching for this function but as of the date of the filing of this application such equipment is not now developed.

Referring briefly to FIG. 4, a typical three phase grid input 80 is illustrated. Input 80 inputs to a three phase primary 82 of a transformer. The transformer secondaries provide first, high voltage outputs $A_1$, $A_2$, $B_1$, $B_2$, $C_1$, and $C_2$. It is these high voltage outputs which enables the rapid ramping of the magnet M to its classifying magnetic field.

The secondary mid taps $a_2$, $a_2$, $b_1$, $b_2$, $c_1$ and $c_2$ have a lower nominal voltage and output that amount of power required for the rectifiers to drive the magnet at its desired power.

There has been shown as a preferable combination with this invention circuit arrays of rectifiers. The reader will understand that other arrays of rectifiers can be used as well and that the invention is not limited either to the three phase circuits herein disclosed nor any other converter capable of regeneration.

Figure 5:
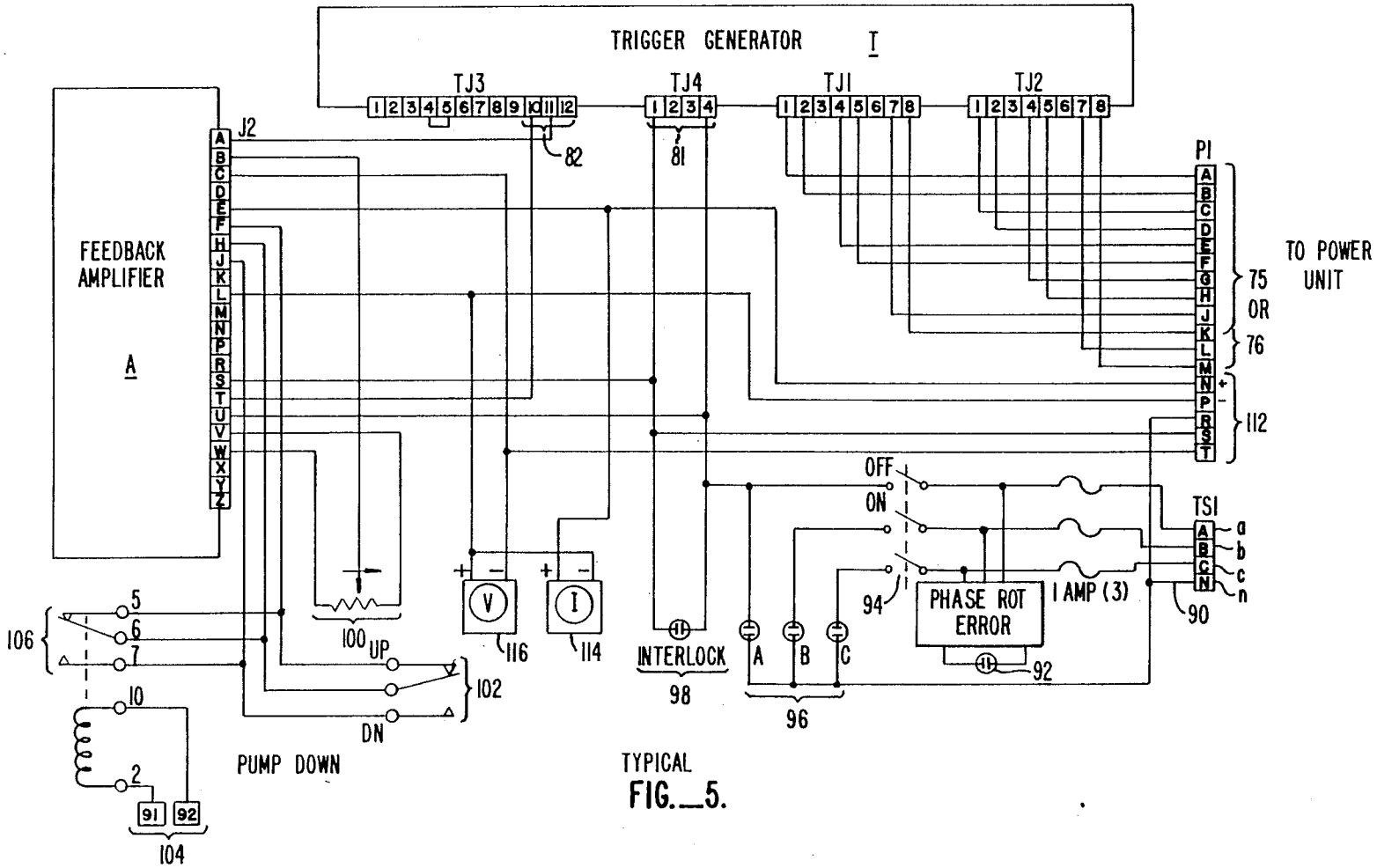
FIG. 5 is a typical view of a control for one of the power supplies, it being realized that two such controls are utilized.

Control of a typical silicon controlled rectifier for modes 1 and 2 are relatively easy to understand. Referring to FIG. 5, a trigger generator manufactured by the Enerpro Company of Goleta, Calif. is illustrated. Trigger generator receives a control voltage input 82 and generates outputs on lines 75, 76 to drive the silicon controlled rectifiers. As such drives are known, the construction and operation of the circuit illustrated in FIG. 5 will be briefly described.

Input from the three-phase service at a, b, and c is detected for phase rotation error at 92, switched at 94 with the presence of each of the phases being indicated at instrument lights 96. An interlock indicator 98 indicates the readiness of the feedback amplifier and the trigger generator. A precision voltage source 100 is generated from a potentiometer connected to feedback amplifier A. Feedback amplifier A is a standard item of manufacture available from the Nutek Corporation of Mountain View, Calif. The switching 102 controls feedback amplifier A. In the up position, such switching enables imposition of direct current to the magnet. In the down position, line commutated inversion occurs from the collapsing magnetic field to the grid.

External switching of the control unit is provided. The relay input terminals 104 operate relay contacts 106.

Referring to FIG. 4, the power supply includes shunt 230. Shunt 230 is monitored by respective tabs 112. This shunt measures the load current which is indicated by amp meter 114. The load voltage is indicated by meter 116. Feedback amplifier A serves to control trigger generator T. Specifically, by comparing the current 114 with the precision voltage reference 100, the retard angle of the trigger generators T is altered. These trigger generators operate to turn on the respective SCRs for those intervals of the 60 hertz cycle necessary to drive the coils of magnet M.

Having set forth the overall construction of the driving circuit, operation can now be set forth.

Initially the first mode of the dual mode power supply is utilized. Silicon controlled rectifiers 201, 203, 205, 207, 209, and 211 are driven at a current flow capable of exceeding the nominal operating current. A rapid acceleration of current occurs in the magnet M.

When current flow reaches the range of nominal amps, sequential switching means 240 on a first silicon rectifier control circuit (such as that illustrated in FIG. 4) shuts down rectifiers 201, 203, 205, 207, 209 and 211 and brings on line the second rectifiers 202, 204, 206, 208, 210, and 212. At the same time a second control circuit (substantially identical with that circuitry disclosed in FIG. 5), brings the second mode of the dual converter circuit on line. After the charging interval a classifying magnetic field is imposed on the magnet M (see FIG. 3B).

Referring further to FIG. 5, when required to collapse the magnetic field, relay 104 is activated producing a down switch position at switch 102. This produced switching is possible on either of the dual modes of the power supply. Selecting the second mode of the power supply for this juncture, rectifiers 202, 204, 206, 208, 210 and 212 are each switched on during the final and latter half of the positive voltage cycle present in each of the phases a, b, and c. According to well known principles and by line commutated conversion, power is extracted from the collapsing magnetic field. This power is fed back to the grid through power connections $A_2$, $B_2$, and $C_2$ and main connections 80.

It will thus be understood we have discovered the ability of the illustrated large magnet to be subjected to rapid increases and rapid decreases of magnetic field. The disclosed dual mode power supply takes advantage of this phenomenon to produce the improved duty cycle illustrated in FIGS. 3A and 3B.

It will be understood that in the preferred embodiment of this invention we do not show a magnet with so-called super conducting capabilities. This should not exclude the applicability of this disclosure to these magnets. The principles herein set forth for the rapid imposition and decay of the magnetic fields remain unchanged in a super conducting environment.

What is claimed is:

1. A combination of a large magnet for classifying magnetic particles from a passing fluid stream of magnetic and nonmagnetic particles, said large magnet including a central canister having a diameter exceeding 60-inches;

first and second manifolds for communicating said passing fluid stream of magnetic and nonmagnetic particles through said canister;

magnetic coils placed around said canister for inducing a magnetic field for effecting the classification, said magnetic field passing through said canister;

a magnetic field conducting core surrounding said canister and coils, said core including at least 6 side-by-side beams having solid interiors for the conduction of said magnetic field, said beams placed on the top and on the bottom of said magnetic core to form a magnetic field conducting path around said coils;

a power supply for driving direct current through said coils to induce upon said magnet through said coils a classifying magnetic field, said power supply having communication to alternating electrical current input, the improvements to said power supply comprising in combination:

a first solid state rectifier circuit, said first solid state rectifier circuit sized with respect to said canister, coils, and magnetic field conducting core to drive an immediate voltage across said coils which would ultimately induce a current at an amperage in excess of that current required for maintaining said magnet at said field for classification of said magnetic particles from said nonmagnetic particles;

a second solid state rectifier circuit, said second solid state rectifier circuit sized with respect to said canister, coils, and magnetic field conducting core to drive a voltage across said coils which will induce a current through said coils at an amperage required for maintaining said magnet field at said classifying field;

first power supply drive means operatively connected to said first solid state rectifier circuit to drive said coils when said magnet is initially imposed with a magnetic field; and, second power supply drive means operatively connected to said second solid state rectifier circuit array and said first power supply drive means for switching off said first power supply drive means and on said second solid state rectifier circuit array when said first power supply approaches a rate of current flow required to maintain the classifying magnetic field of said magnet whereby said magnet is accelerated to its full classifying field.

2. The invention of claim 1 and wherein said second solid state rectifier circuit is sized with respect to said canister, coils, and magnetic field conducting core to have a power factor of greater than 0.8.

3. The invention of claim 1 and including third means for switching one of said power supplies to line commutated inversion upon desired decay of said magnetic field whereby energy of said magnetic field is extracted from said magnet.

4. A process for energizing a large magnet for classifying magnetic particles from a passing fluid stream of magnetic and nonmagnetic particles and wherein said magnet includes a central canister having a diameter exceeding 60 inches.

magnetic coils placed adjacent and around said canister for including a magnetic field through said canister; a magnetic field conducting core surrounding said canister and coils for conducting a magnetic field around said canister and through said core, said laminated core including at least 6 side-by-side beams on the top and 6 side-by-side beams on the bottom portion thereof, each said beam having solid interiors for the conduction of said magnetic field;

said process comprising the steps of;

providing a first solid state rectifier circuit array, said first solid state rectifier circuit array sized with respect to said canister coils and magnetic field conducting core to impose an immediate voltage across said coils sufficient to drive a current through said coils in excess of that current required for maintaining said magnet at a field required for classification of said magnetic particles from said nonmagnetic particles;

providing a second solid state rectifier circuit array, said second solid state rectifier circuit sized with respect to said canister coils and magnetic field conducting core to impose a voltage across said coils to drive a current through said magnet at an amperage required for maintaining said coils at said classifying field when said second solid state rectifier array is producing substantially full output;

switching said first solid state rectifier circuit array to impose said immediate voltage to pass current through the coils of said magnet when said magnet is initially imposed with a magnetic field; and switching off said first solid state rectifier circuit array and on said second solid state rectifier circuit array when the current in said coils approaches a rate of current flow required to maintain the classifying magnetic field of said magnet whereby said magnet is accelerated to its full classifying field.

* * * * *